US006353960B1

(12) United States Patent
Jannicelli, Jr.

(10) Patent No.: US 6,353,960 B1
(45) Date of Patent: Mar. 12, 2002

(54) HELPER ATTACHMENT DEVICES FOR CLEANING

(76) Inventor: Edward Jannicelli, Jr., 1785 Rose Blvd., Nashville, NC (US) 27856

( * ) Notice: Subject to any disclaimer, the term of this patent is extended or adjusted under 35 U.S.C. 154(b) by 0 days.

(21) Appl. No.: 09/326,809

(22) Filed: Jun. 4, 1999

(51) Int. Cl.[7] ..... A47L 13/12

(52) U.S. Cl. ..... 15/246; 15/106; 15/111; 15/114; 15/115; 15/118; 15/121; 15/398; 15/405

(58) Field of Search ..... 15/246, 111, 106, 15/114, 118, 398, 405, 112, 115, 121, 117

(56) References Cited

U.S. PATENT DOCUMENTS

| | | | | |
|---|---|---|---|---|
| 597,246 | A | * | 1/1898 | Pratt |
| 1,402,485 | A | * | 1/1922 | Fredriitsen |
| 1,752,400 | A | * | 4/1930 | Sund |
| 1,857,668 | A | * | 5/1932 | Sund |
| 2,163,979 | A | * | 6/1939 | Judson |
| 2,666,221 | A | * | 1/1954 | Stepper |
| 2,687,542 | A | * | 8/1954 | Turausky |
| 2,741,788 | A | * | 4/1956 | Shey |
| 3,733,636 | A | * | 5/1973 | Osadsky |
| 5,054,159 | A | * | 10/1991 | Richardson |
| 5,161,772 | A | * | 11/1992 | Diresta |

FOREIGN PATENT DOCUMENTS

| | | | |
|---|---|---|---|
| DE | 213934 | * | 2/1909 |
| FR | 1030474 | * | 3/1953 |

* cited by examiner

*Primary Examiner*—Randall E. Chin

(57) ABSTRACT

A convenient helper attachment device adapted for use in combination with cleaning apparatuses/units is for use as a universal back up for the cleaning apparatus. The cleaning apparatus has a near end for being held by a user and a far end for supporting the attachment device. The helper attachment device has a head portion and coupling mechanism including a clamping assembly comprising a pair of clamping members dimensioned for coupling with the cleaning apparatus/unit. Tabs, each provided with an aperture, extend upwardly from the upper end of each clamping member. A fastener extends through the apertures of the tabs for securement of the pair of clamping members to the helper attachment device. The clamping assembly is couplable to the attachment device and the head portion is adapted for coupling to a cleaning apparatus/unit.

2 Claims, 7 Drawing Sheets

10

14
12
20
2
2
18
16

40
42
38
36
20
44
4
3
4
46
26
28
3
24
32
30

Fig. 5
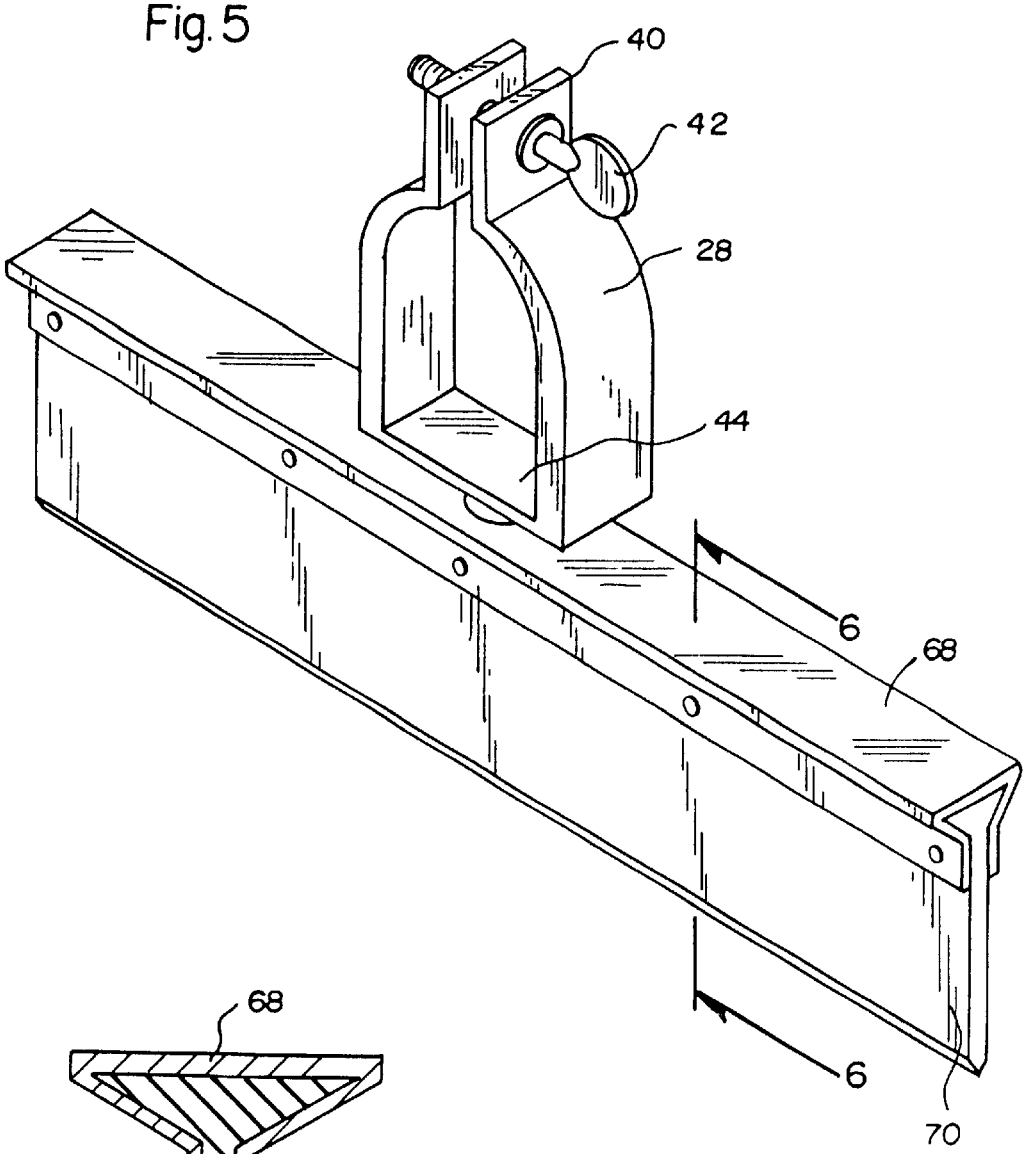
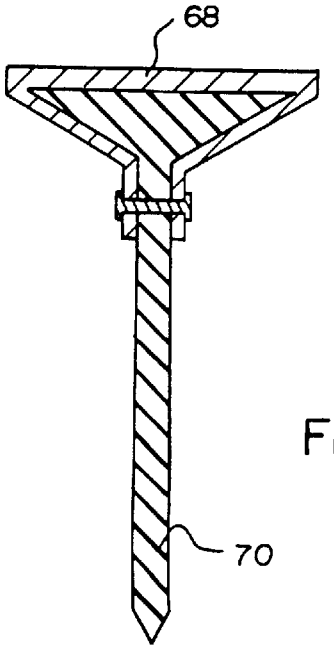
Fig. 6

FIG 9
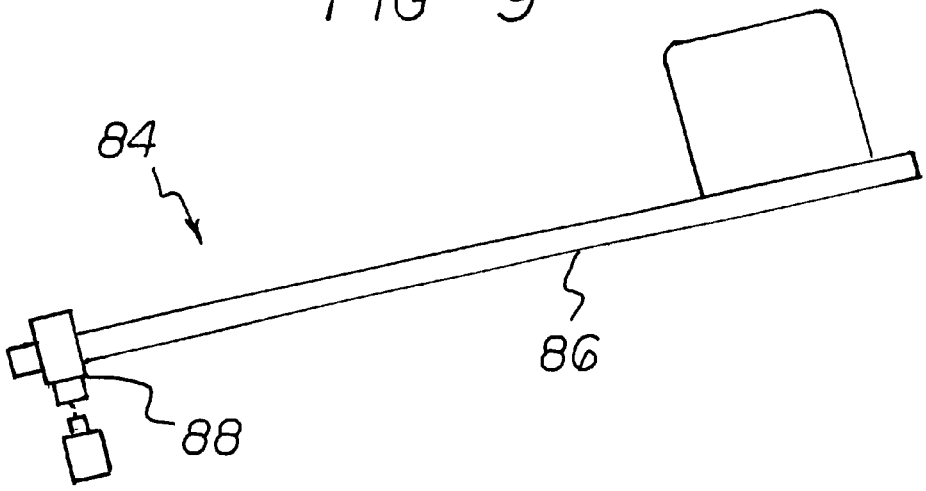
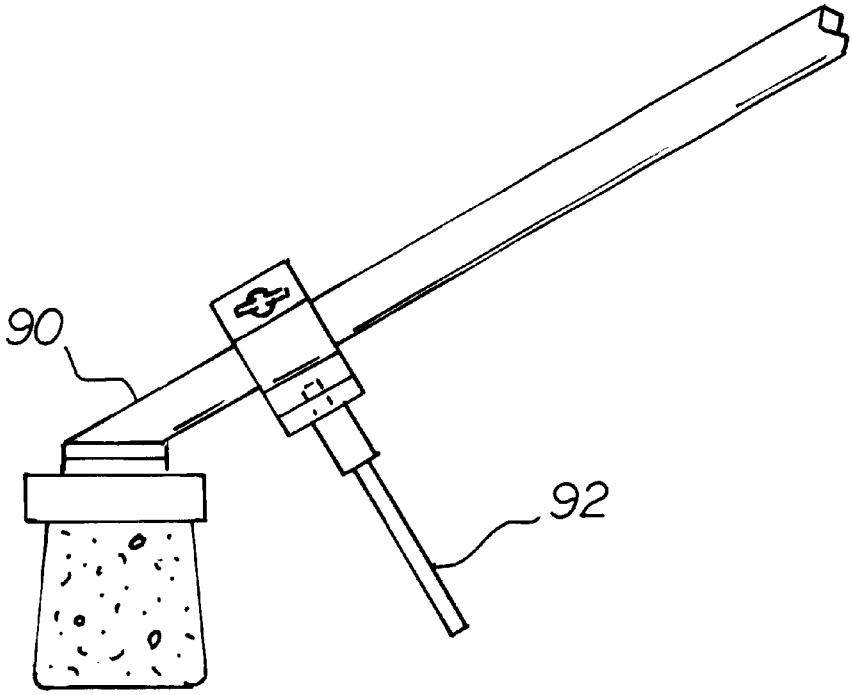
FIG 10

FIG 14
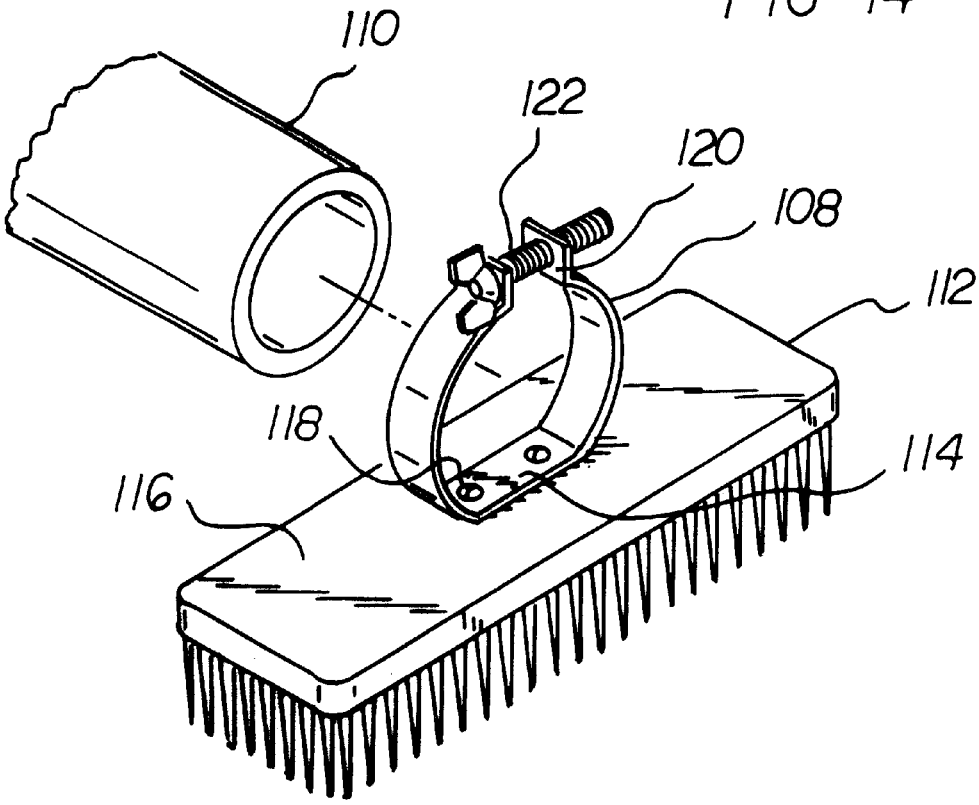
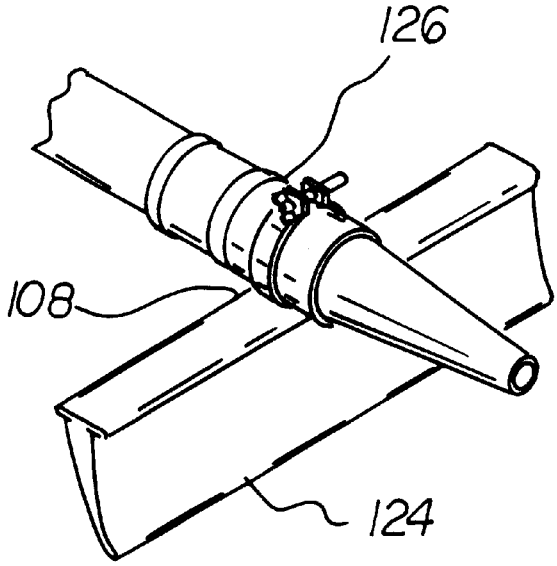
FIG 15

HELPER ATTACHMENT DEVICES FOR CLEANING

BACKGROUND OF THE INVENTION

1. Field of the Invention

The present invention relates to helper attachment devices for cleaning apparatuses/units and more particularly pertains to improving the cleaning capabilities of apparatuses/units by the selective coupling of helper attachment devices.

2. Description of the Prior Art

The use of cleaners and blowers and other primary cleaning apparatuses/units is known in the prior art. More specifically, cleaners and blowers and other primary cleaning apparatuses/units heretofore devised and utilized for the purpose of cleaning and area of debris are known to consist basically of familiar, expected and obvious structural configurations, notwithstanding the myriad of designs encompassed by the crowded prior art which have been developed for the fulfillment of countless objectives and requirements.

The most pertinent pieces of prior art include U.S. Pat. No. 2,598,499 to G. W. Breuer et al. issued May 27, 1952; U.S. Pat. No. 4,945,604 to Miner et al. issued Aug. 7, 1990; and U.S. Pat. No. 5,054,159 to Richardson issued Oct. 8, 1991, to Richardson. With regard to the Breuer device, a bar or rod 42 is coupled by a screw 43 to the free end of a blower through an adapter 38. In such embodiment, special components must be constructed for at least partially covering the exit end of the blower, the primary tool. Such an arrangement is not a universally adaptable system including a primary tool with a first axis and a secondary tool with a secondary axis perpendicular to the primary axis.

The Miner device is directed to a portable blower and includes a brush-like attachment 1000 couplable to the free end of the blower. Such attachment, however, extends into the outlet orifice of the blower to interfere with the normal functioning of the primary tool.

The third reference, that to Richardson, has a similar defect in that it requires a specially modified primary tool, a blower, with a trapezoidal-type attachment 13 integrally formed with the original equipment. As such, there is no universality of different attachments adapted to be coupled with regard to a primary tool.

By way of example, U.S. Pat. No. 4,513,471 to Rahn discloses a sweeper blower device. U.S. Pat. No. 4,817,235 to Doxey et al. discloses a pneumatic pavement cleaning apparatus. U.S. Pat. No. 5,222,275 to Baker et al. discloses a blower vacuum. U.S. Pat. No. 5,272,858 to Bonis discloses an attachment for leaf blowers. U.S. Pat. No. 5,414,889 to Sartori discloses a broom with position-maintaining multi-angle handle interconnector.

While these devices fulfill their respective, particular objective and requirements, the aforementioned patents do not describe helper attachment devices for cleaning apparatuses/units for attaching to a cleaning apparatus to provide improved cleaning capabilities.

In this respect, the helper attachment devices for cleaning apparatuses/units according to the present invention substantially departs from the conventional concepts and designs of the prior art, and in doing so provides an apparatus primarily developed for the purpose of attaching to a cleaning apparatus to provide improved cleaning capabilities.

Therefore, it can be appreciated that there exists a continuing need for new and improved helper attachment devices for cleaning apparatuses/units which can be used for attaching to a cleaning apparatus to provide improved cleaning capabilities. In this regard, the present invention substantially fulfills this need.

SUMMARY OF THE INVENTION

In the view of the foregoing disadvantages inherent in the known types of cleaners and blowers now present in the prior art, the present invention provides improved helper attachment devices for cleaning apparatuses/units. As such, the general purpose of the present invention, which will be described subsequently in greater detail, is to provide new and improved helper attachment devices for cleaning apparatuses/units and method which has all the advantages of the prior art and none of the disadvantages.

To attain this, the present invention essentially comprises a convenient helper attachment device for cleaning apparatuses/units. The helper attachment device is adapted for use as a universal back up for services that the cleaning apparatus cannot finalize for the purpose of saving time and energy by cleaning with the helper attachment device in combination with the cleaning apparatus. The cleaning apparatus has a near end for being held by a user and a far end for supporting the attachment device. In this manner there is no interference with the construction or operation of the cleaning apparatus. The cleaning apparatus may be selected from the class of cleaning apparatuses including mops, brooms, hoses, and blowers, or the like. The helper attachment device comprises, in combination, a head portion. The head portion has an upper surface and a lower surface. The head portion also has a coupling mechanism including a clamping assembly comprising a pair of clamping members. The clamping members are dimensioned for coupling with the cleaning apparatus/unit. A tab extends upwardly from an upper end of each clamping member. Each tab is provided with an aperture. A thumbscrew extends through the apertures of the tabs for securement of the pair of clamping members to the helper attachment device. The clamping assembly is couplable to the attachment device. The head portion is adapted for coupling to a cleaning apparatus/unit. The helper attachment device is selected from the class of attachment devices including brushes, scrapers, squeegees, and the like. A coupling mechanism is secured to the helper attachment device and is adapted to be removably received on the cleaning apparatus/unit adjacent to the far end.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved helper attachment devices for cleaning apparatuses/units which has all the advantages of the prior art cleaners and blowers and none of the disadvantages.

It is another object of the present invention to provide a new and improved helper attachment devices for cleaning apparatuses/units which may be easily and efficiently manufactured and marketed.

It is a further object of the present invention to provide a new and improved helper attachment devices for cleaning apparatuses/units which is of durable and reliable construction.

An even further object of the present invention is to provide a new and improved helper attachment devices for cleaning apparatuses/units which is susceptible of a low cost of manufacture with regard to both materials and labor, and which accordingly is then susceptible of low prices of sale to the consuming public, thereby making such helper attachment devices for cleaning apparatuses/units economically available to the buying public.

Still yet another object of the present invention is to provide a new and improved helper attachment devices for cleaning apparatuses/units which provides in the apparatuses and methods of the prior art some of the advantages thereof, while simultaneously overcoming some of the disadvantages normally associated therewith.

Even still another object of the present invention is to provide a new and improved helper attachment devices for cleaning apparatuses/units for attaching to a cleaning apparatus to provide improved cleaning capabilities.

Lastly, it is an object of the present invention to provide new and improved helper attachment devices for cleaning apparatuses/units including a convenient helper attachment device for cleaning apparatuses/units adapted for use as a universal back up for services that the cleaning apparatus cannot finalize for the purpose of saving time and energy by cleaning with the helper attachment device, the helper attachment adapted for use in combination with the cleaning apparatus. The cleaning apparatus has a near end for being held by a user and a far end for supporting the attachment device. There is no interference with the construction or operation of the cleaning apparatus. The cleaning apparatus is selected from the class of cleaning apparatuses including mops, brooms, hoses, blowers, and the like. The helper attachment device comprises, in combination, a head portion. The head portion has an upper surface and a lower surface and coupling mechanism. The coupling mechanism includes a clamping assembly comprising a pair of clamping members. The clamping members are dimensioned for coupling with the cleaning apparatus/unit. A tab extends upwardly from from an upper end of each clamping members. Each tab is provided with an aperture. A thumbscrew extends through the apertures of the tabs for securement of the pair of clamping members to the helper attachment device. The clamping assembly is couplable to the attachment device. The head portion is adapted for coupling to a cleaning apparatus/unit. The helper attachment device may be selected from the class of attachment devices including brushes, scrapers, squeegees, and the like. A coupling mechanism is secured to the helper attachment device and adapted to be removably received on the cleaning apparatus/unit adjacent to the far end.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a perspective view of a second embodiment of the present invention.

FIG. 6 is a cross-sectional view as taken along line 6—6 of FIG. 5.

FIG. 9 is a generic showing of the cleaning apparatus/unit in combination with a detachable and replaceable helper attachment device with universal coupling mechanisms therebetween.

FIG. 10 is the showing of a mop adapted to be used as a cleaning apparatus/unit for us in association with any of a plurality of helper attachment devices.

FIG. 14 illustrates a cleaning appratus/unit and a helper attachment in a separated orientation, but with a modified coupling element.

FIG. 15 is similar to FIG. 14 but with the apparatus/unit and helper attachment coupled.

The same reference numerals refer to the same parts throughout the various Figures.

DESCRIPTION OF THE PREFERRED EMBODIMENT

Figure 1:
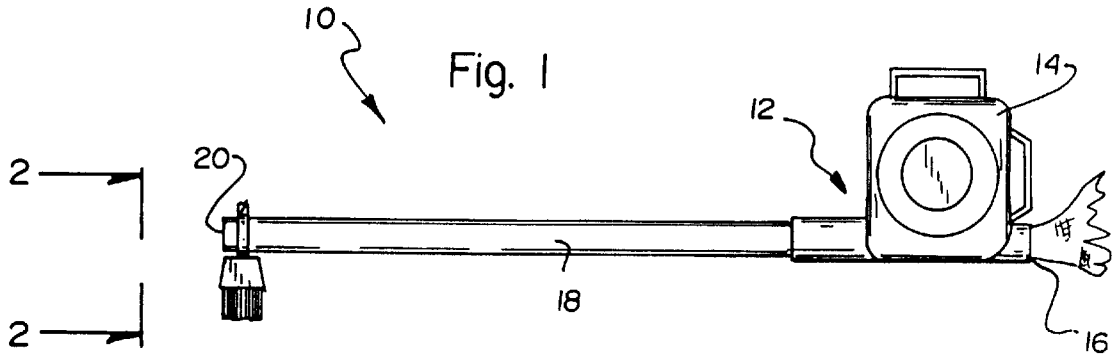
FIG. 1 is a perspective view of the preferred embodiment of the helper attachment devices for cleaning apparatuses/units constructed in accordance with the principles of the present invention.
Figure 2:
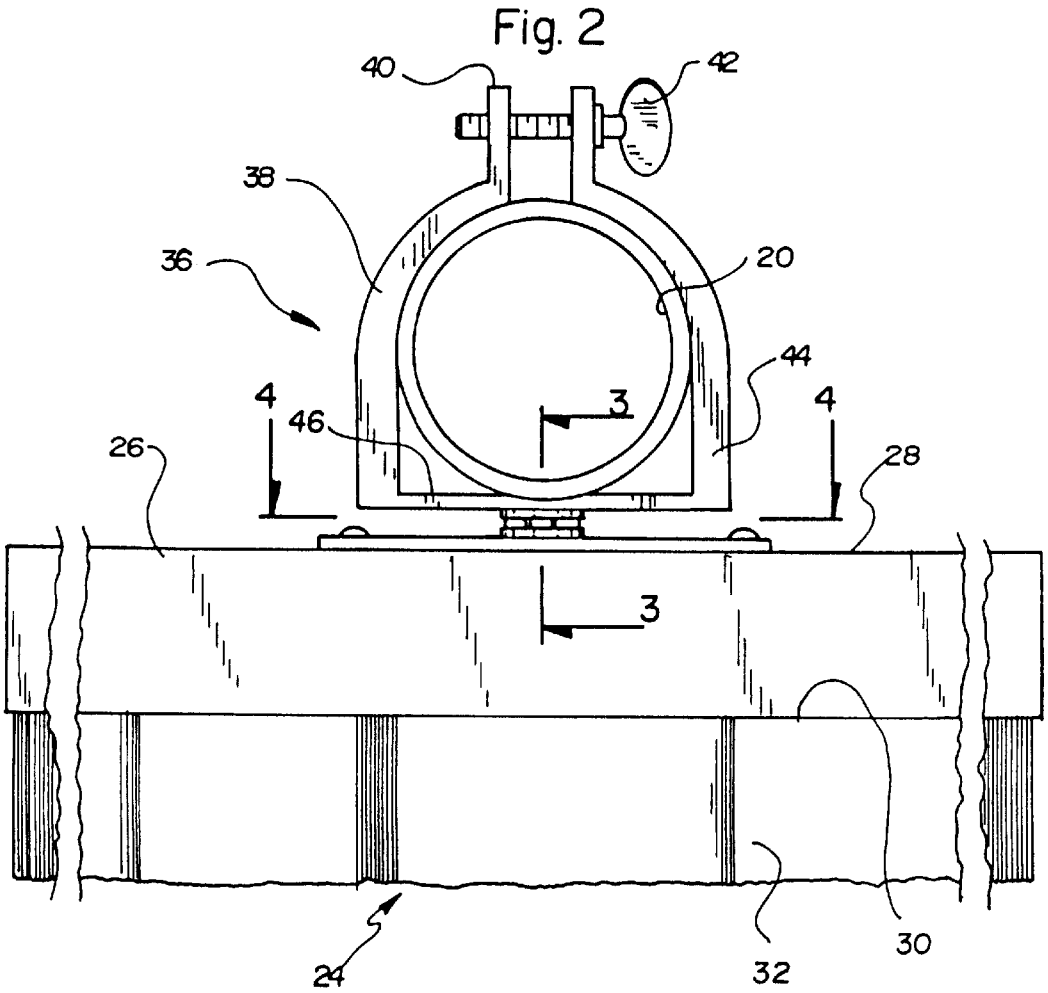
FIG. 2 is a front elevation view of the present invention.
Figure 3:
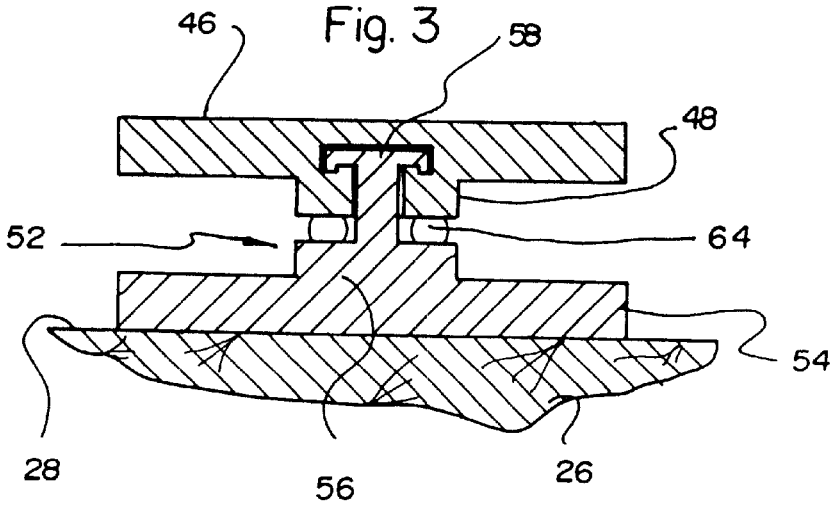
FIG. 3 is a cross-sectional view as taken along line 3—3 of FIG. 2.
Figure 4:
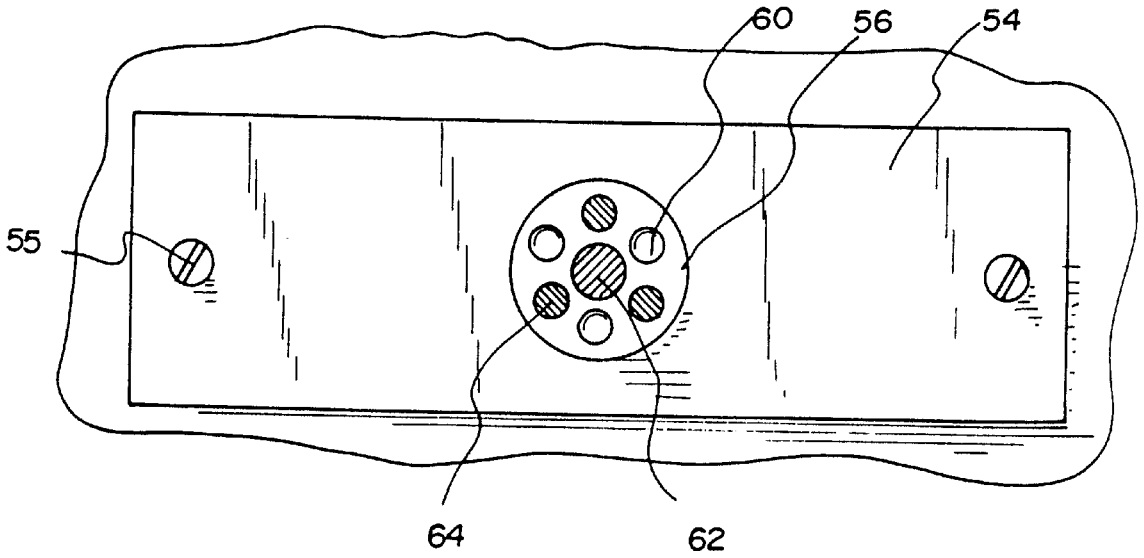
FIG. 4 is a cross-sectional view as taken along line 4—4 of FIG. 2.

With reference now to the drawings, and in particular, to FIGS. 1–6 thereof, the preferred embodiment of the new and improved helper attachment devices for cleaning apparatuses/units embodying the principles and concepts of the present invention and generally designated by the reference number 10 will be described.

Specifically, it will be noted in the various Figures that the device relates to a helper attachment device for cleaning apparatuses/units for attaching to a cleaning apparatus to provide improved cleaning capabilities. In its broadest context, the device consists of a helper attachment device adapted for use in association with a cleaning apparatus/unit.

The device 10 includes a leaf blower 12 having a motor housing 14. The motor housing 14 has a bag 16 extending from a rear portion thereof. The motor housing 14 has an elongated tube 18 extending from a front portion thereof. The elongated tube 18 has an open free end 20. The leaf blower 12 is of the type know in the art.

The device 10 includes a broom attachment 24 comprised of a head portion 26. The head portion 26 has an upper surface 28 and a lower surface 30. A plurality of bristles 32 extend downwardly from the lower surface 30. The materials used to comprise the plurality of bristles 32 are of the type known used in the various types of scrub brushes known in the art.

Next, the device 10 includes a clamp assembly 36 comprised of a pair of clamping members 38 dimensioned for coupling with the elongated tube 18 of the leaf blower 12 inwardly of the open free end 20 thereof. Each clamping member 38 has a tab 40 extending upwardly from upper ends thereof. Each tab 40 has a threaded aperture therethrough. A thumbscrew 42 extends through the threaded apertures of the tabs 40 for securement of the pair of clamping members 38 to the elongated tube 18. The clamping members 38 are slightly flexible to allow the clamp assembly 36 to be positioned on the elongated tube 18. The thumb screw 42 will secure the clamp assembly in place on the elongated tube 18 by pinching in on the clamping members 38 around the elongated tube 18. Alternately, loosening of the thumb screw 42 will allow for the clamping assembly 36 to be removed from the elongated tube 18. Lower ends 44 of the pair of clamping members 38 have a cross member 46 extending therebetween. The cross member 46 has a downwardly extending central portion 48.

Lastly, the device 10 includes a pivot assembly 52 comprised of a plate member 54 secured to the upper surface 28 of the head portion 26 of the broom attachment 24. The plate member 54 is secured to the head portion 26 by a pair of screws 55 extending through the plate member 54 and into the head portion 26. Alternately, the device 10 can be incorporated into an existing broom or other cleaning apparatus. The plate member 54 has an upwardly extending central portion 56. A T-shaped stem 58 extends upwardly from the upwardly extending central portion 56 to rotatably couple with the downwardly extending central portion 48 of the cross member 46 of the clamp assembly 36. The upwardly extending central portion 56 has a plurality of sockets 60 formed in an upper surface thereof surrounding a shaft 62 of the T-shaped stem 58. A plurality of ball bearings 64 are positioned within the plurality of sockets 60 to facilitate rotation of the pivot assembly 52 relative to the clamp assembly 36.

A second embodiment of the present invention is shown in FIGS. 5 and 6 and includes substantially all of the components of the present invention wherein the attachment is a squeegee and the cleaning apparatus is a wet/dry vacuum. The squeegee is comprised on an elongated head portion 68. The elongated head portion 68 has an elongated planar rubber strip 70 extending downwardly therefrom. The squeegee is used in association with the wet/dry vacuum to maneuver water in hard to reach places to be sucked up by the vacuum. The squeegee incorporates the clamp assembly 36 and the pivot assembly 52 to couple the squeegee with a hose or tube of the vacuum.

Figure 7:
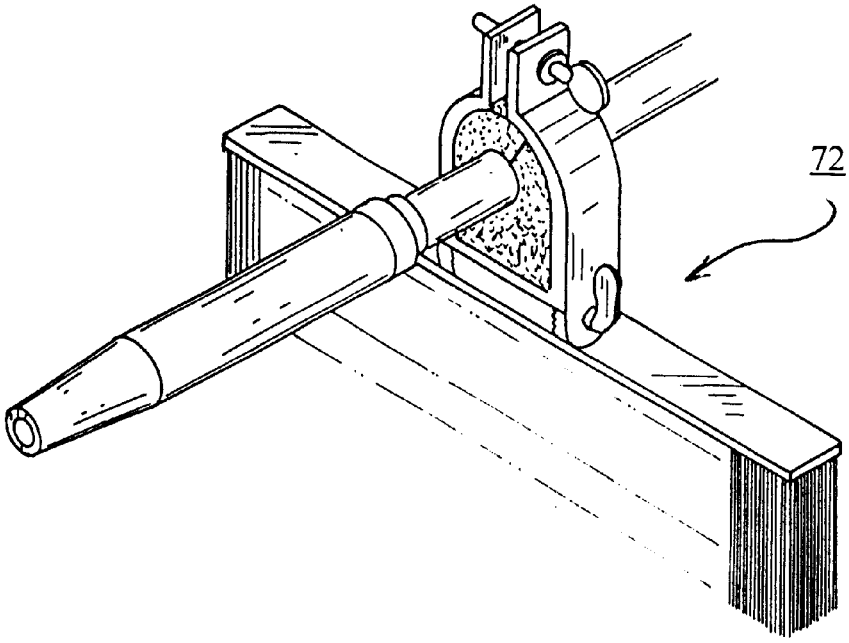
FIG. 7 is a perspective view of a third embodiment of the present invention.
Figure 8:
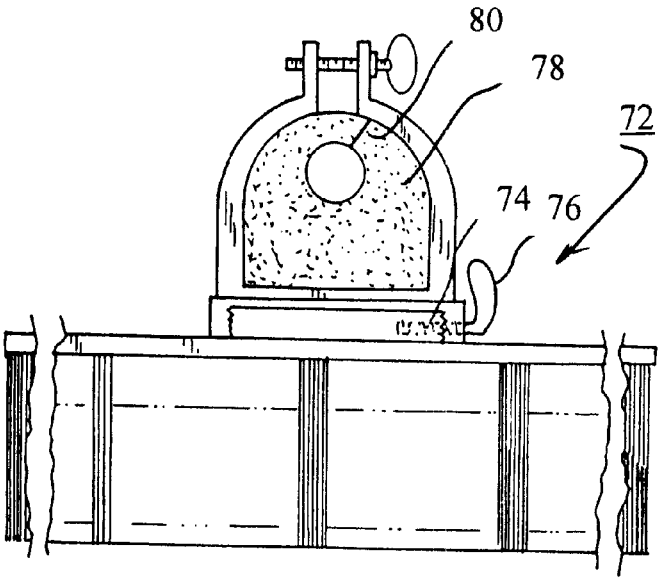
FIG. 8 is a front elevational view of the attachment device of FIG. 7.

A third embodiment 72, as shown in FIGS. 7 & 8, includes a hinge assembly 74 rotatably coupled with the downwardly extending central portion of the cross member of the clamp assembly in lieu of the pivot assembly. The hinge assembly is further secured to the upper surface of the head portion of the attachment. In addition, the hinge assembly comprises a spring-biased locking mechanism 76. In use, the locking mechanism has a first orientation for allowing free movement of the hinge assembly and further a second orientation for precluding movement of the hinge assembly thus securing the attachment in a selected orientation.

As an option, any one of the embodiments may include an elastomeric insert 78 situatable between the clamping members of the clamp. The insert has a cut out 80 centrally formed therein. A slit 82 is formed between the cut out and a periphery of the insert. As such, a tool with a small diameter may be situated within the cut out via the slit whereat the insert may be inserted between the clamping members. The insert thus allows the utilization of a tool with a small diameter such as a garden hose, garden tool, or the like.

Figure 11:
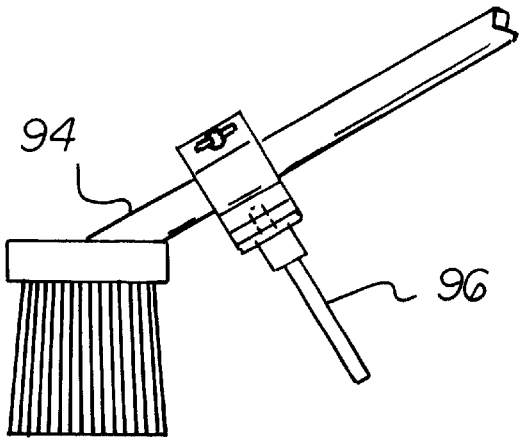
FIG. 11 is a showing of a broom, rather than a mop, adapted to be used as a cleaning apparatus/unit in association with any of the helper attachment devices similar to that of FIG. 10.
Figure 12:
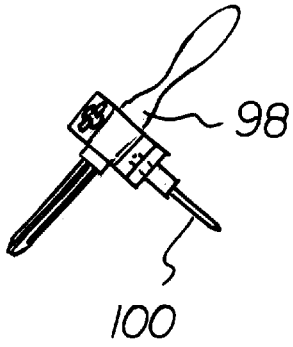
FIG. 12 is a showing of a paint brush adapted to be used as a cleaning apparatus/unit in association with the helper attachment devices similar to the showings hereinabove.
Figure 13:
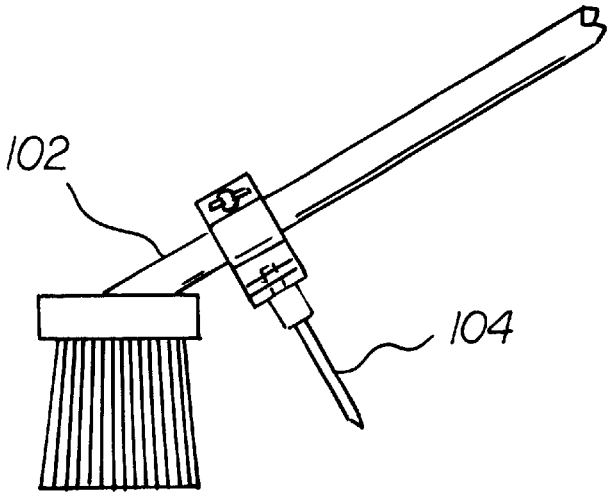
FIG. 13 is a showing of a scraper adapted to be used as a helper attachment device in association with any of the above-described cleaning apparatuses/units in system configuration.

The embodiments of FIGS. 9 through 11 show several variations of the invention. FIG. 9 includes a system 84 with a generic type cleaning apparatus/unit 86 in combination with a generic type detachable and replaceable helper attachment device 88. FIG. 10 illustrates a mop 90 as the apparatus/unit and a scraper 92 as the helper attachment device. FIG. 11 has a broom 94 with a scraper 96. FIG. 12 shows a paintbrush 98 with a scraper 100. FIG. 13 has a broom 102 with a scraper 104. Any of the various helper attachment devices may be used with any of the various cleaning apparatus/units.

Modified coupler elements 108 are shown in FIGS. 14 and 15. In FIG. 14, such embodiment shows the apparatus/unit 110 spaced from the helper attachment device 112. The coupler elements include a simple strap 114 constituting a hose-type clamp. Apertures 114 at the center allow coupling to the back of a brush 116 by screws 118. Apertures 120 at the ends of the strap allow usage of a wing bolt 122 for attachment, release, and tightening purposes. Other types of couplers, threaded or otherwise, could readily be utilized for this function. FIG. 15 shows the coupling elements 108 securing a squeegee 124 to a water hose nozzle 126.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed is:

1. An attachment device adapted for use in combination with a primary cleaning apparatus, the primary cleaning apparatus being of the type having a near end for being held by a user and a far end for performing a cleaning function and with an intermediate region there adjacent for supporting an attachment device without interfering with the operation of the primary cleaning apparatus, the attachment device comprising, in combination:

a head portion having an upper surface and a lower surface and coupling mechanisms including a clamping assembly comprising a pair of clamping members dimensioned for coupling with the intermediate region of the primary cleaning apparatus, each clamping member having a tab extending upwardly from an upper end thereof, each tab having an aperture therethrough, and a threaded fastener extending through the apertures of the tabs out of contact with the primary cleaning apparatus for securement of the pair of clamping members to the primary cleaning apparatus, the clamping assembly being removably couplable to the attachment device, the head portion being adapted for coupling to the intermediate region of the cleaning apparatus without modifying the primary cleaning apparatus, the attachment device being selected from the class of attachment devices consisting of brushes, squeegees, and brooms.

2. An attachment device in combination with a primary cleaning apparatus, the primary cleaning apparatus having a near end for being held by a user and a far end for performing a cleaning function and with an intermediate region there adjacent for supporting an attachment device without interfering with the operation of the primary cleaning apparatus,-the primary cleaning apparatus being selected from the class of cleaning apparatuses consisting of mops, brooms, hose nozzles, blowers and brushes, comprising:

a head portion having an upper surface and a lower surface and coupling mechanisms including a clamping assembly comprising a pair of clamping members dimensioned for removable coupling with the primary cleaning apparatus, each clamping member having a tab extending upwardly from an upper end thereof, each tab having an aperture therethrough, and a threaded member extending through the apertures of the tabs out of contact with the primary cleaning apparatus for securement of the pair of clamping members to the primary cleaning apparatus without modifying the primary cleaning apparatus, the attachment device being selected from the class of attachment devices consisting of brushes, squeegees and brooms.

* * * * *